US009962023B1

(12) United States Patent
Lauritano

(10) Patent No.: US 9,962,023 B1
(45) Date of Patent: May 8, 2018

(54) SPORTS BALL-SHAPED DRINKING CONTAINER

(71) Applicant: Victor Lauritano, Highlands, NJ (US)

(72) Inventor: Victor Lauritano, Highlands, NJ (US)

( * ) Notice: Subject to any disclaimer, the term of this patent is extended or adjusted under 35 U.S.C. 154(b) by 67 days.

(21) Appl. No.: 15/187,925

(22) Filed: Jun. 21, 2016

(51) Int. Cl.

| | |
|---|---|
| ***A61J 9/06*** | (2006.01) |
| ***B65D 77/26*** | (2006.01) |
| ***A47G 19/22*** | (2006.01) |
| ***A47G 21/18*** | (2006.01) |
| ***B65D 47/08*** | (2006.01) |
| ***B65D 41/02*** | (2006.01) |
| ***B65D 25/16*** | (2006.01) |

(52) U.S. Cl.
CPC ..... *A47G 19/2227* (2013.01); *A47G 21/18* (2013.01); *B65D 25/16* (2013.01); *B65D 41/02* (2013.01); *B65D 47/0857* (2013.01)

(58) Field of Classification Search
CPC ..... A47G 19/2227; A47G 21/18; A47G 2200/02; A47G 19/2266; A47G 19/2255; B65D 25/16; B65D 41/02; B65D 47/0857; B65D 81/389; B65D 81/36; B65D 77/065; B65D 81/3846; B65D 11/02; A61J 9/06; A61J 9/0607; A61J 9/0615
USPC ..... 220/708, DIG. 13, 560; 206/457; D7/606, 604
See application file for complete search history.

(56) References Cited

U.S. PATENT DOCUMENTS

| | | | | |
|---|---|---|---|---|
| 1,370,432 | A * | 3/1921 | Gvosdenovich | B63C 9/21 220/560 |
| 3,119,543 | A * | 1/1964 | Walker | B65D 77/065 220/495.03 |
| 3,223,289 | A * | 12/1965 | Bouet | A45D 40/00 141/24 |
| D228,328 | S * | 9/1973 | Schley | D21/712 |
| 4,164,284 | A * | 8/1979 | Witt | B65D 81/3846 206/217 |
| 4,330,066 | A * | 5/1982 | Berliner | B65D 23/00 215/12.1 |
| 5,088,948 | A * | 2/1992 | Scheurer | A47G 19/2266 215/388 |
| 5,450,979 | A * | 9/1995 | Servick | B65D 81/365 206/217 |
| 5,503,296 | A | 4/1996 | DiBaggio | |
| D371,934 | S * | 7/1996 | Cwirko | D7/511 |
| 5,662,241 | A * | 9/1997 | Sorensen | B65D 23/001 220/630 |
| D392,844 | S * | 3/1998 | Todorya | D7/606 |

(Continued)

FOREIGN PATENT DOCUMENTS

CN 2320583 Y 5/1999

*Primary Examiner* — J. Gregory Pickett
*Assistant Examiner* — Gideon Weinerth
(74) *Attorney, Agent, or Firm* — Kyle A. Fletcher, Esq.

(57) ABSTRACT

The ball-shaped drinking container is adapted for use in containing beverages. The ball-shaped drinking container is contained within a shell that may be formed in the shape of a sports ball potentially including, but not limited to, a football, a baseball, a basketball, or a soccer ball. The ball-shaped drinking container is formed in such a manner that the ball-shaped drinking container will float. This feature makes the ball-shaped drinking container suitable for outdoor use by an end user. The ball-shaped drinking container comprises a shell, a hinged lid, and a bladder.

9 Claims, 5 Drawing Sheets

(56) References Cited

U.S. PATENT DOCUMENTS

| | | | | | |
|---|---|---|---|---|---|
| 5,727,709 | A * | 3/1998 | Nobile | B65D 81/3886 | 220/560 |
| 5,996,427 | A * | 12/1999 | Masek | B01L 3/505 | 73/863.52 |
| 6,135,286 | A * | 10/2000 | Strumor | A45C 11/20 | 206/573 |
| D460,693 | S * | 7/2002 | Flowers | D9/519 | |
| 7,516,869 | B1 | 4/2009 | Hajianpour | | |
| D594,701 | S | 6/2009 | Sax | | |
| D621,657 | S | 8/2010 | Quinn | | |
| 8,403,778 | B2 * | 3/2013 | Wallach | A63B 43/002 | 473/596 |
| 8,770,434 | B2 * | 7/2014 | Shearer | A47G 19/2261 | 220/603 |
| D711,690 | S * | 8/2014 | Sutton | D7/625 | |
| D790,282 | S * | 6/2017 | Price | D7/564 | |
| 2008/0223739 | A1 * | 9/2008 | Thompson | A47G 19/2227 | 206/217 |
| 2013/0087524 | A1 * | 4/2013 | Nuckles | A61J 9/005 | 215/395 |
| 2013/0299443 | A1 * | 11/2013 | Stewart | A61J 9/0607 | 215/11.6 |
| 2015/0257558 | A1 * | 9/2015 | May | A47G 19/2272 | 220/669 |
| 2015/0259114 | A1 * | 9/2015 | Tussy | B65D 81/365 | 206/457 |
| 2015/0289690 | A1 * | 10/2015 | Parker | A45F 3/16 | 220/560 |

* cited by examiner

SPORTS BALL-SHAPED DRINKING CONTAINER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of containers for storage and transport, more specifically, a preformed container for beverages.

SUMMARY OF INVENTION

The ball-shaped drinking container is adapted for use in containing beverages. The ball-shaped drinking container is contained within a shell that is formed in the shape of a sports ball potentially including, but not limited to, a football, a baseball, a basketball, or a soccer ball. The ball-shaped drinking container is formed in such a manner that the ball-shaped drinking container will float. This feature makes the ball-shaped drinking container suitable for outdoor use.

These together with additional objects, features and advantages of the ball-shaped drinking container will be readily apparent to those of ordinary skill in the art upon reading the following detailed description of the presently preferred, but nonetheless illustrative, embodiments when taken in conjunction with the accompanying drawings.

In this respect, before explaining the current embodiments of the ball-shaped drinking container in detail, it is to be understood that the ball-shaped drinking container is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ball-shaped drinking container.

It is therefore important that the claims be regarded as including such equivalent construction insofar as they do not depart from the spirit and scope of the ball-shaped drinking container. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
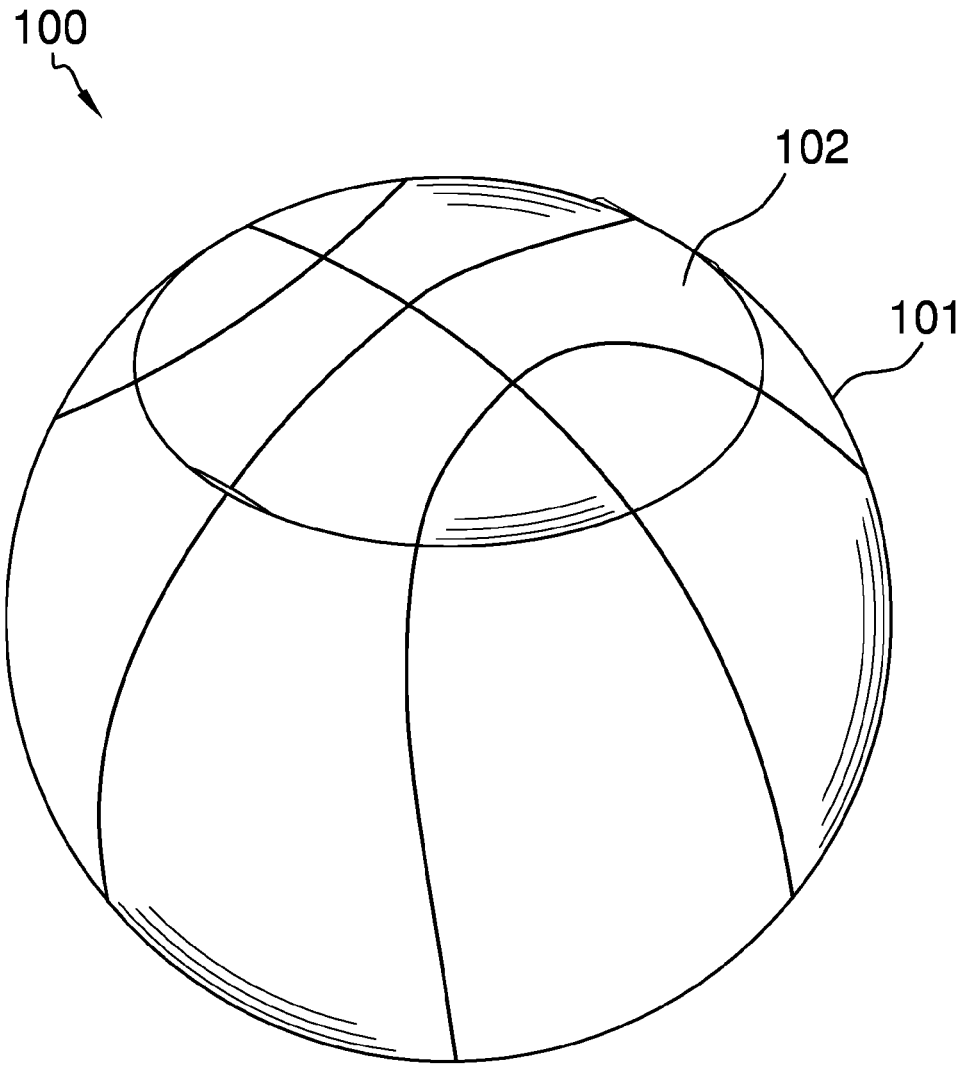
FIG. 1 is a perspective view of an embodiment of the disclosure.
Figure 2:
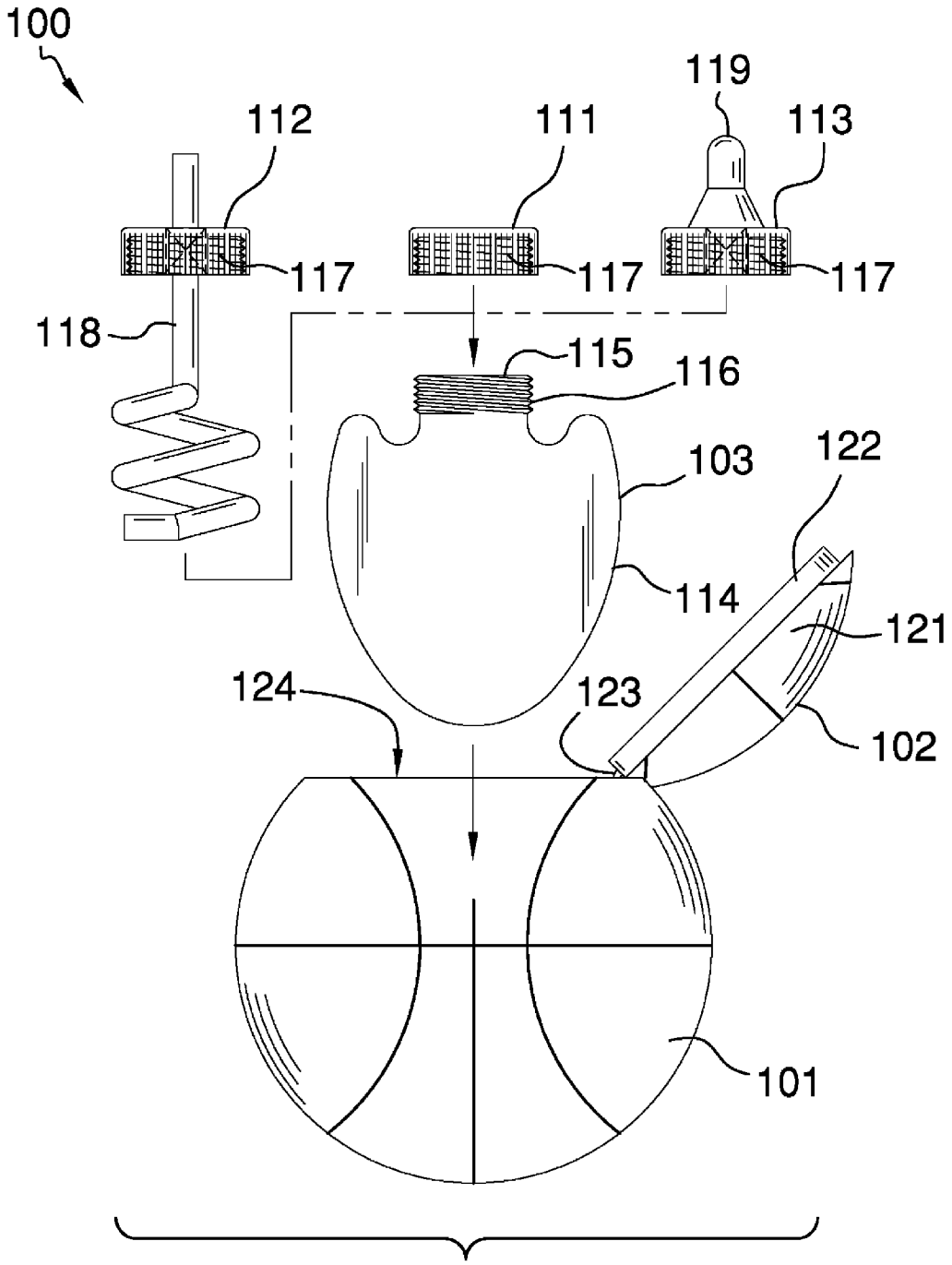
FIG. 2 is an exploded view of an embodiment of the disclosure.
Figure 3:
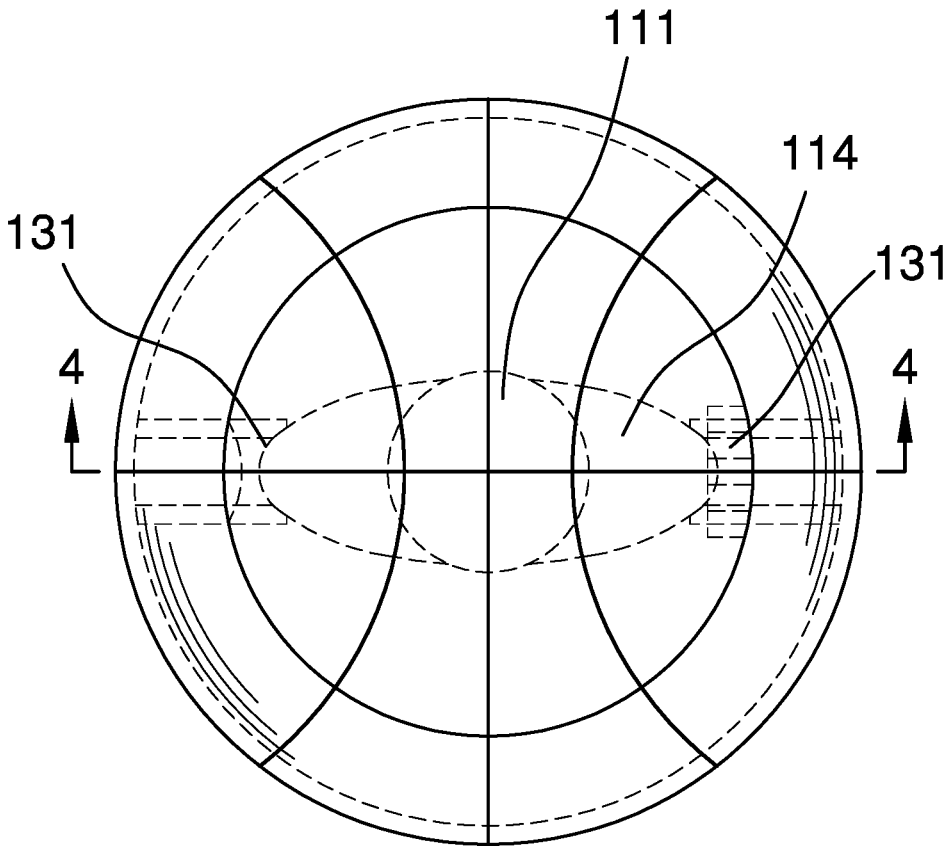
FIG. 3 is a top view of an embodiment of the disclosure.
Figure 4:
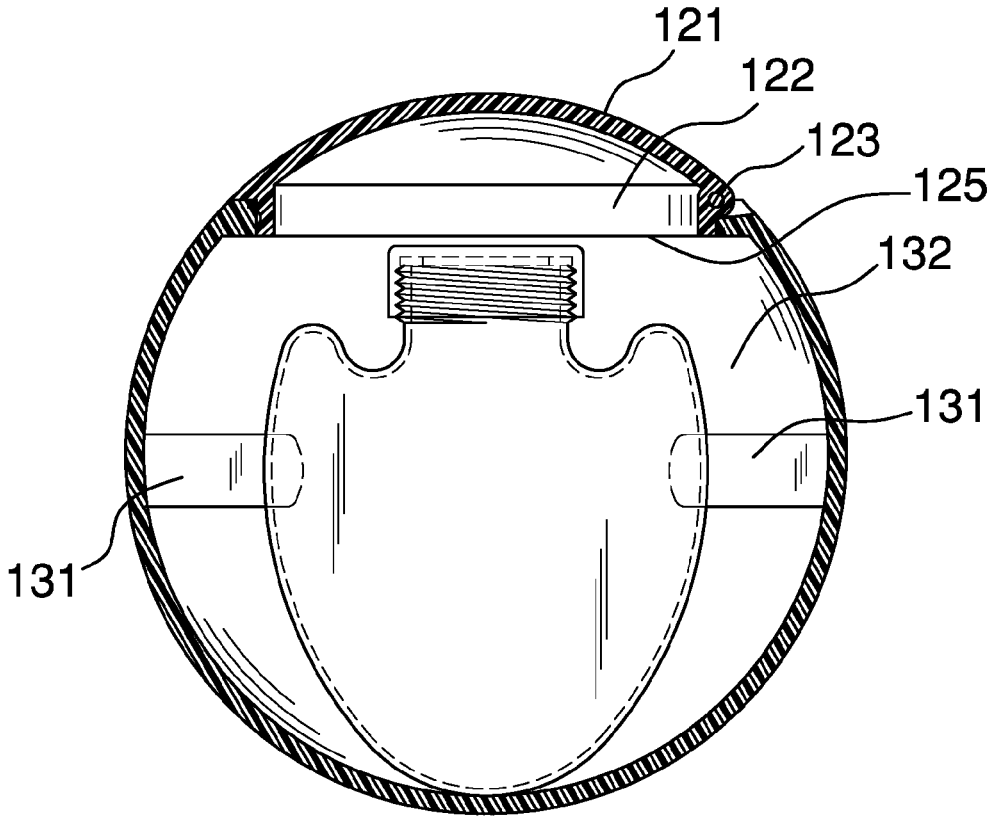
FIG. 4 is a cross-sectional view of an embodiment of the disclosure across 4-4 as shown on FIG. 3.
Figure 5:
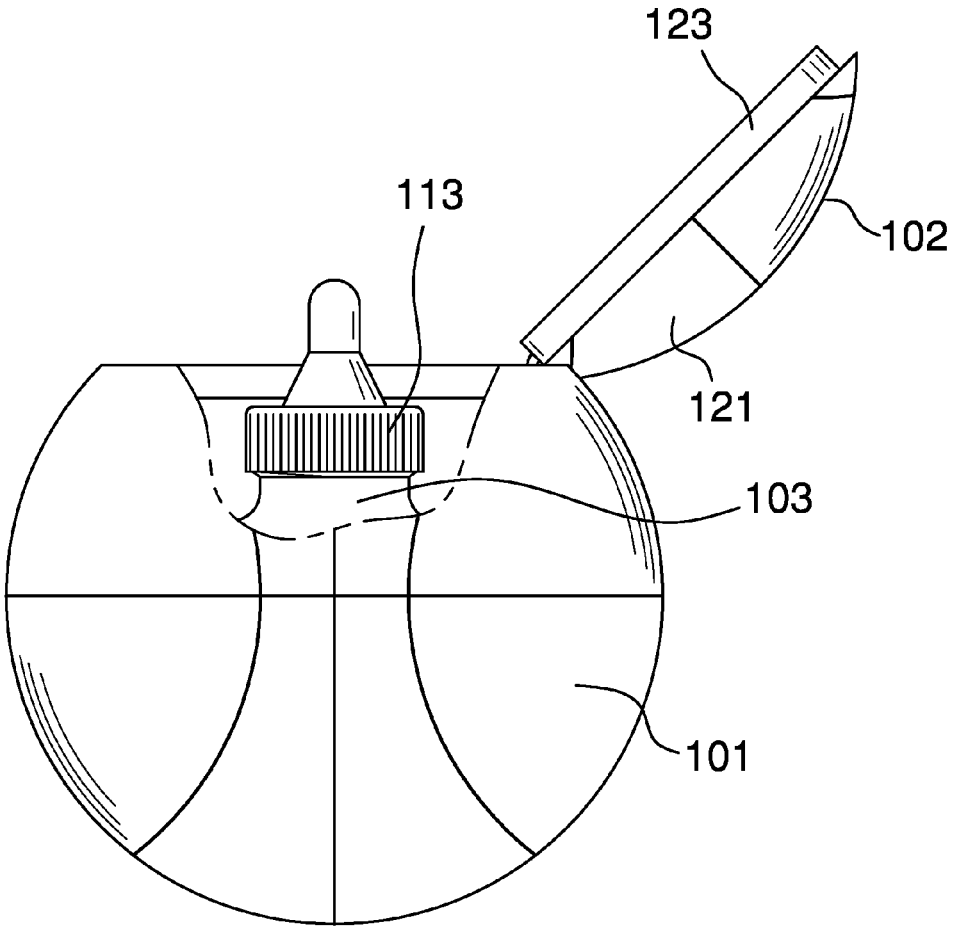
FIG. 5 is an in use view of an embodiment of the disclosure.

Detailed reference will now be made to a first potential embodiment of the disclosure, which is illustrated in FIGS. 1 through 5.

The ball-shaped drinking container 100 (hereinafter invention) comprises a shell 101, a hinged lid 102, and a bladder 103. The invention 100 is adapted for use in containing beverages. The invention 100 is contained within the shell 101. The shell 101 is optionally formed in the shape of a sports ball. The invention 100 is formed in such a manner that the invention 100 will float. This feature makes the invention 100 suitable for outdoor use by anyone.

The shell 101 is a hollow container within which is stored the bladder 103. As an end user holds the invention 100 to drink a beverage, the end user will grip the shell 101. The shell 101 further comprises an aperture 124 and a plurality of bladder clips 131. The shell 101 is further defined with an interior space 132. The aperture 124 is an opening through which the bladder 103 can be inserted into the interior space 132 of the shell 101. The plurality of bladder clips 131 are clips that are used to hold the bladder 103 securely in position while the bladder 103 is contained within the shell 101.

The hinged lid 102 is a covering that fits over the aperture 124. The hinged lid 102 further comprises a cover 121, a seal 122, and a hinge 123. The cover 121 is a barrier that is designed to fit over the aperture 124 such that, when the hinged lid 123 is in position, access to the interior space 132 of the shell 101 is blocked. The cover 121 is further defined with an interior surface 125 that faces the interior space 132 when the hinged lid 102 is in the closed position. The interior surface 125 is fitted with a seal 122. The seal 122 is made of an elastomeric material that deforms slightly when the cover 121 is positioned to close the aperture 124. This deformation creates a water tight seal that prevents liquids released by the bladder from escaping through the aperture 124 when the hinged lid 102 is closed. The hinge 123 is commercially available hardware that is used to attach the cover 121 to the shell 101 such that the cover 121 can rotate away from the shell 101 using the hinge 123 as a pivot.

The shell 101 and the hinged lid 102 are formed from molded plastic in the shape of a sports ball. The exterior of the combination of the shell 101 and the hinged lid 102 will be formed and decorated such that the appearance of a sports ball may be given. Suitable sports balls into which the shell 101 and the hinged lid 102 can be formed include, but are not limited to, a football, a baseball, a basketball, a soccer ball, a bowling ball, a rugby ball, a golf ball, or a volley ball. The shell 101 and the hinged lid 102 can further be decorated with logos identifying one or more teams (presumably) favored by the user. Methods to form containers and hinged lids from molded plastic are well known and documented in the mechanical arts.

The bladder 103 further comprises a closing cap 111, a straw cap 112, a nipple cap 113, a drink bag 114, and a threaded opening 115. The drink bag 114 is a readily and commercially available hydration reservoir. The drink bag 114 further comprises a threaded opening 115 through which a liquid can be introduced into and removed from the drink bag 114. The threaded opening 115 is an opening formed in the drink bag 114 with a perimeter that is formed by an exterior screw thread 116. The exterior screw thread 116 provides a location to which the closing cap 111, the straw cap 112, the nipple cap 113 can be attached. The closing cap 111 is a capped cylindrical tube that is formed with an interior screw thread 117. The closing cap 111 and the interior screw thread 117 are sized such that the closing cap 111 will fit over the threaded opening 115 and the interior screw thread 117 will screw onto the exterior screw thread 116.

The straw cap 112 is a capped cylindrical tube that is formed with an interior screw thread 117 and a straw 118 that is fitted through the closed end of the capped cylindrical tube. The straw cap 112 and the interior screw thread 117 are sized such that the straw cap 112 will fit over the threaded opening 115 and the interior screw thread 117 will screw onto the exterior screw thread 116. The straw 118 allows the end user to drink liquids from the drink bag 114 via the straw 118.

The nipple cap 113 is a capped cylindrical tube that is formed with an interior screw thread 117 and a nipple 119 that is fitted through the closed end of the capped cylindrical tube. The nipple cap 113 and the interior screw thread 117 are sized such that the nipple cap 113 will fit over the threaded opening 115 and the interior screw thread 117 will screw onto the exterior screw thread 116. The nipple 119 allows an infant or infant as the end user to drink liquids from the drink bag 114.

To use the invention 100, the hinged lid 102 is rotated away from the shell 101. The bladder 103 is removed from the interior space 132 and the closing cap 111 is removed. The drink bag 114 is filled with a beverage and the drink bag 114 is sealed with either the straw cap 112 or the nipple cap 113 by screwing the straw cap 112 or the nipple cap 113 onto the drink bag 114 using the threaded connection 115. Beverages can then be taken from the invention 100 normally.

The following definitions were used in this disclosure:

Elastic: As used in this disclosure, an elastic is a material or object that deforms when a force is applied to it and that is able to return to its original shape after the force is removed. A material that exhibits these qualities is also referred to as an elastomeric material.

Exterior Screw Thread: An exterior screw thread is a ridge wrapped around the outer surface of a tube in the form of a helical structure that is used to convert rotational movement into linear movement.

Hinge: As used in this disclosure, a hinge is a device that permits the turning, rotating, or pivoting of a first object relative to a second object.

Interior Screw Thread: An interior screw thread is a ridge wrapped around the inner surface of a tube in the form of a helical structure that is used to convert rotational movement into linear movement Pivot: As used in this disclosure, a pivot is a rod, shaft or other device around which an object rotates or swings.

Toddler: As used in this disclosure, a toddler is a human child between the ages of one and three who has learned to walk.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A drink container comprising:

a shell, a hinged lid, and a bladder;

wherein the drink container is adapted for use in containing beverages;

wherein the shell is formed such that the drink container will float;

wherein the shell is a hollow container that is further defined with an interior space;

wherein the bladder is stored within the interior space;

wherein the shell further comprises an aperture and a plurality of bladder clips;

wherein the plurality of bladder clips are used to hold the bladder securely in position while the bladder is contained within the interior space;

wherein the hinged lid is a covering that fits over the aperture;

wherein the hinged lid further comprises a cover, a seal, and a hinge;

wherein the hinged lid is further defined with an interior surface;

wherein the cover is a barrier that fits over the aperture such that, when the hinged lid is in position access to the interior space is blocked;

wherein the cover is further defined with an interior surface that faces the interior space when the hinged lid is in the closed position;

wherein the interior surface is fitted with a seal;

wherein the seal is made of an elastomeric material;

wherein the seal prevents liquids released by the bladder from escaping through the aperture when the hinged lid is closed.

2. The drink container according to claim 1 wherein the hinge attaches the cover to the shell such that the cover can rotate away from the shell using the hinge as a pivot.

3. The drink container according to claim 2 wherein the drink container is formed in the shape of a sports ball; wherein the exterior of the combination of the shell and the hinged lid will be formed and decorated such that the appearance of a sports ball is given.

4. The drink container according to claim 3 wherein the sports ball is selected from the group consisting of a football, a baseball, a basketball, a soccer ball, a bowling ball, a rugby ball, a golf ball, or a volley ball.

5. The drink container according to claim 3 wherein the bladder further comprises a drink bag;

wherein the drink bag further comprises a threaded opening.

6. The drink container according to claim 5 wherein a closing cap comprises first capped cylindrical tube that is formed with an interior screw thread;

wherein the closing cap and the interior screw thread are sized such that the closing cap will fit over the threaded opening and the interior screw thread will screw onto the exterior screw thread.

7. The drink container according to claim 6 wherein the straw cap comprises second capped cylindrical tube that is formed with an interior screw thread and a straw;

wherein the straw is fitted through the closed end of the second capped cylindrical tub;

wherein the straw cap and the interior screw thread are sized such that the straw cap will fit over the threaded opening and the interior screw thread will screw onto the exterior screw thread.

8. The drink container according to claim 7 wherein the nipple cap comprises third capped cylindrical tube that is formed with an interior screw thread and a nipple;

wherein the nipple is fitted through the closed end of the third capped cylindrical tube;

wherein the nipple cap and the interior screw thread are sized such that the nipple cap will fit over the threaded opening and the interior screw thread will screw onto the exterior screw thread.

9. The drink container according to claim 8 wherein the shell and the hinged lid is further decorated with logos.

* * * * *